US009068253B2

(12) United States Patent
Kato et al.

(10) Patent No.: US 9,068,253 B2
(45) Date of Patent: Jun. 30, 2015

(54) STEEL PLATE WITH EXCELLENT HYDROGEN INDUCED CRACKING RESISTANCE, AND MANUFACTURING METHOD OF THE SAME

(71) Applicant: Kobe Steel, Ltd., Kobe (JP)

(72) Inventors: Taku Kato, Kakogawa (JP); Hiroki Imamura, Kakogawa (JP); Shinsuke Sato, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 300 days.

(21) Appl. No.: 13/833,478

(22) Filed: Mar. 15, 2013

(65) Prior Publication Data

US 2013/0260164 A1 Oct. 3, 2013

(30) Foreign Application Priority Data

Mar. 30, 2012 (JP) ..... 2012-083077

(51) Int. Cl.

| | |
|---|---|
| ***C22C 38/26*** | (2006.01) |
| ***C22B 9/00*** | (2006.01) |
| ***C22C 38/14*** | (2006.01) |
| ***C22C 38/12*** | (2006.01) |
| ***C22C 38/08*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C22C 33/04*** | (2006.01) |
| ***C21D 6/00*** | (2006.01) |
| ***C21D 8/02*** | (2006.01) |

(52) U.S. Cl.

CPC . *C22C 38/26* (2013.01); *C22B 9/00* (2013.01); *C22C 38/14* (2013.01); *C22C 38/12* (2013.01); *C22C 38/08* (2013.01); *C22C 38/06* (2013.01); *C22C 38/04* (2013.01); *C22C 38/02* (2013.01); *C22C 38/005* (2013.01); *C22C 38/002* (2013.01); *C22C 38/001* (2013.01); *Y10T 428/12* (2015.01); *C22C 33/04* (2013.01); *C21D 6/005* (2013.01); *C21D 8/02* (2013.01)

(58) Field of Classification Search

None

See application file for complete search history.

(56) References Cited

U.S. PATENT DOCUMENTS 4,143,211 A * 3/1979 Obinata et al. ..... 428/650
4,153,454 A * 5/1979 Emi et al. ..... 420/83

(Continued)

FOREIGN PATENT DOCUMENTS

JP 3846233 9/2006
JP 2008-7841 A 1/2008

(Continued)

OTHER PUBLICATIONS

Extended European Search Report issued Nov. 18, 2013 in Patent Application No. 13001595.1.

*Primary Examiner* — Deborah Yee

(74) *Attorney, Agent, or Firm* — Oblon, McClelland, Maier & Neustadt, L.L.P.

(57) ABSTRACT

A steel plate is provided which has excellent hydrogen induced cracking resistance. The steel plate is suitable for use in a line pipe. The steel plate satisfies a predetermined composition. In a composition of an inclusion contained in the steel and having a width of 1 μm or more, the ratio (RES/CaS) of the mass of an REM sulfide (RES) to that of a Ca sulfide (CaS) is equal to or more than 0.05, a Zr content of the inclusion is in a range of 5 to 60%, and a Nb content of the inclusion is 5% or less.

5 Claims, 4 Drawing Sheets

(56) References Cited

U.S. PATENT DOCUMENTS

| | | | | |
|---|---|---|---|---|
| 4,285,741 | A * | 8/1981 | Furukawa et al. | 148/504 |
| 4,804,021 | A * | 2/1989 | Hasegawa et al. | 138/171 |

FOREIGN PATENT DOCUMENTS

| | | | |
|---|---|---|---|
| JP | 2011-68949 | | 4/2011 |
| KR | 10-2011-0104111 | A | 9/2011 |

* cited by examiner

STEEL PLATE WITH EXCELLENT HYDROGEN INDUCED CRACKING RESISTANCE, AND MANUFACTURING METHOD OF THE SAME

FIELD OF THE INVENTION

The present invention relates to steel plates with excellent hydrogen induced cracking resistance, and manufacturing methods of the same.

BACKGROUND OF THE INVENTION

With the development of degradation resources, including crude oil or gas containing hydrogen disulfide, line pipes and storage tanks used for transportation and storage of the resources are required to have excellent sour resistance, such as hydrogen induced cracking resistance (hereinafter referred to as a "HIC resistance"), or sulphide stress corrosion cracking resistance (hereinafter referred to as a "SSCC resistance"). Especially, the hydrogen induced cracking is known to be caused in the following mechanism. Specifically, hydrogen entering the steel in a corrosion reaction would be gathered at MnS that is likely to extend in a rolling direction to cause the concentration of stress, or at non-metal inclusions including relatively coarse Nb(C, N) particles left after melting in heating a slab, into gas to cause cracking.

Some techniques for improving the above HIC resistance have been hitherto proposed. For example, Japanese Patent Publication No. 3846233 discloses a steel having improved HIC resistance by controlling an average Mn content and a maximum Mn content of the thickness-directional center of the steel. Such a method can improve the HIC resistance, but does not control inclusions located at a center segregation part, which makes it difficult to prevent fine cracking.

Japanese Unexamined Patent Publication No. 2011-68949 discloses a steel plate which exhibits excellent toughness by appropriately adjusting the amounts of addition of REM and Ca respective to a S content so as to suppress a MnS content. In this way, the addition of REM and Ca can suppress the formation of MnS. However, in order to surely improve the HIC resistance, it is also necessary to appropriately control other sulfides (sulfides of REM and Ca).

SUMMARY OF THE INVENTION

The present invention has been made taking into consideration the above circumstances, and it is an object of the present invention to achieve a steel plate with sufficiently excellent hydrogen induced cracking resistance by controlling the composition of inclusions contained in the steel, and to establish a manufacturing method useful for obtaining the above steel plate.

A steel plate with the excellent hydrogen induced cracking resistance that can solve the above problems according to the invention contains:

C: 0.02 to 0.20% (in percentage by mass, note that the same goes for the following chemical components),
Si: 0.02 to 0.50%,
Mn: 0.6 to 2.0%,
P: 0.030% or less,
S: 0.004% or less,
Al: 0.010 to 0.08%,
N, 0.001 to 0.01%,
Nb: 0.002 to 0.06%,
Ca: 0.0003 to 0.0060%,
O: 0.0040% or less, REM: 0.0002 to 0.05%,
Zr: 0.0003 to 0.020%, and
the remainder being iron and inevitable impurities, in which, in a composition of an inclusion included in the steel and having a width of 1 μm or more, a ratio (RES/CaS) of a mass of a REM sulfide (RES) to that of a Ca sulfide (CaS) is equal to or more than 0.05, in which a Zr content of the inclusion is in a range of 5 to 60%, and in which a Nb content of the inclusion is 5% or less.

The above steel plate may further include one or more elements selected from the group consisting of:

Ti: 0.003 to 0.03%,
B: 0.0002 to 0.005%,
V: 0.003 to 0.1%,
Cu: 0.01 to 1.5%,
Ni: 0.01 to 3.5%,
Cr: 0.01 to 1.5%,
Mo: 0.01 to 1.5%, and
Mg: 0.0003 to 0.005%.

The above steel plate is suitable for use in a line pipe. The present invention also covers a steel pipe suitable for use in a line pipe manufactured using the above steel plate.

In a method for manufacturing the steel plate according to the present invention, a smelting process includes the steps of: desulfurizing by use of a slag having a Fe content in a range of 0.1 to 10% so as to set a S content to 0.004% or less; deoxidizing such that a ratio (Of/S) of a dissolved-oxygen (Of) content of a molten steel to a S content of the molten steel is equal to or less than 10; and adding Zr, REM, and Ca in that order, or adding both Zr and REM at the same time and then adding Ca (note that a time period from the addition of the REM to the addition of Ca being set to 4 minutes or more), the above steps being performed in that order. In the method, a time period from the addition of Ca to completion of solidification is within 200 minutes.

The present invention can provide a steel plate and a steel pipe with excellent hydrogen induced cracking resistance. These materials can be suitable for use in a line pipe for transportation of natural gas and crude oil, a tank for storage, and the like.

DETAILED DESCRIPTION OF THE PREFERRED EMBODIMENTS

Figure 1A:
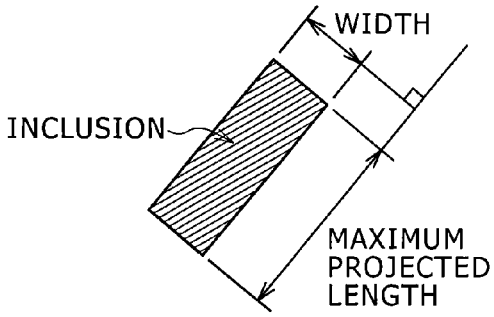
FIGS. 1A and 1B are schematically explanatory diagrams showing the width of an inclusion.

The inventors have studied the cause for HIC, taking into consideration the case where the HIC is caused even when the formation of MnS is suppressed in the related art. Hydrogen entering the steel tends to gather in a void (fine space) formed between the steel (base metal) and a non-metal inclusion. The hydrogen gathered in the void under the sour environment might be likely to cause the HIC. Thus, the inventors have further studied about the improvement of the HIC resistance taking into account the formation of the void described above.

As a result, the inventors have found that the void is formed during a cooling process after a hot rolling process in a manufacturing process of the steel plate. When a thermal expansion coefficient of an inclusion is large with respect to that of a base phase (mainly, iron), the inclusion will shrink largely as compared to the base phase during the cooling process as a result. In other words, if the thermal expansion coefficient of the inclusion is smaller than that of the base phase (mainly iron), the formation of a void can be suppressed. From this point, the specific composition of the inclusion has been studied.

Table 1 gives a comparison among the thermal expansion coefficients of various types of inclusions existing in the steel. Data in Table 1 is cited from the following documents: Iron and Steel Institute of Japan, Basic Research Group, Control Study Division of Texture and Quality of Steel Using Inclusions Contained in Steel: "Use of Fine Inclusions in Microstructure Control of Steels—Literature Survey and Preliminary Study of Controlling Mechanism by Computer Model", published in 15 Sep. 1995; and Hirakawa et al. "Journal of the Mining and Minerals Processing Institute of Japan vol. 119, p 755-758 (2003)."

TABLE 1

| Inclusion composition | $ZrO_2$ | $Al_2O_3$ | $CeO_2$ | $La_2S_3$ | $TiO_2$ | LaS | iron | CeS | MgO | CaO | MnS | CaS |
|---|---|---|---|---|---|---|---|---|---|---|---|---|
| Thermal expansion coefficient ($10^{-6}$/K) | 7.0 | 8.0 | 8.5 | 9.9 | 10.2 | 11.62 | 11.7 | 12.37 | 13 | 13.6 | 17.4 | 19.1 |

Table 1 shows sulfides having the thermal expansion coefficients in the following order, specifically, CaS ($19.1\times10^{-6}$/K)>MnS ($17.4\times10^{-6}$/K)>RES (which is a sulfide of REM, for example, Ces ($12.37\times10^{-6}$/K), LaS ($11.62\times10^{-6}$/K)).

Oxides have the thermal expansion coefficients in the following order, specifically, CaO ($13.6\times10^{-6}$/K)>$REM_2O_3$ (for example, $CeO_2$($8.5\times10^{-6}$/K))>$Al_2O_3$ ($8.0\times10^{-6}$/K)>$ZrO_2$ ($7.0\times10^{-6}$/K).

From the viewpoint of the level of the thermal expansion coefficient, in order to reduce the void between the base phase and the inclusion, the inclusions desirably include RES as a sulfide whose thermal expansion coefficient is equal to or less than that of the base phase (iron), and $ZrO_2$ as an oxide in a large amount whose thermal expansion coefficient is sufficiently smaller than that of the base phase (iron).

From the point above, the present invention defines the composition of an inclusion of interest contained in the steel and having a width of 1 μm or more.

Figure 1B:
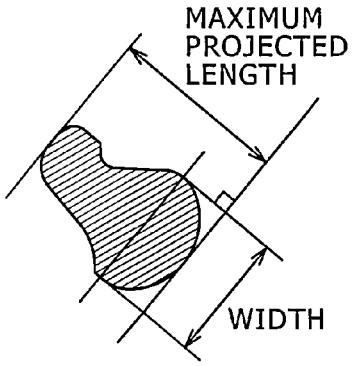

The term "width" of the inclusion as used herein means a maximum length in the direction perpendicular to a maximum projected length (of the major axis) as schematically shown in FIGS. 1A and 1B. Inclusions in size of the order of μm are observed in present steels with HIC. As mentioned above, the invention is directed to the inclusion contained in the steel and having a width of 1 μm or more.

Now, the composition of the inclusion defined by the invention will be described in detail. First, the reason for defining a ratio (RES/CaS) of the mass of a REM sulfide (RES) to that of a Ca sulfide (CaS) will be specifically given below.

The invention positively forms RES as the sulfide as mentioned above, but CaS is likely to be easily formed as the sulfide rather than RES in a smelting process. Further, MnS is also likely to be formed as the sulfide, but extends in a rolling direction to cause the concentration of stress. Thus, it is necessary to suppress the formation of MnS.

From this viewpoint, the invention suppresses the formation of MnS by forming CaS, and controls the S content of the inclusion using the ratio (RES/CaS) of the mass of the REM sulfide (RES) to that of the Ca sulfide (CaS) so as to ensure a constant RES content respective to a CaS content.

Figure 2:
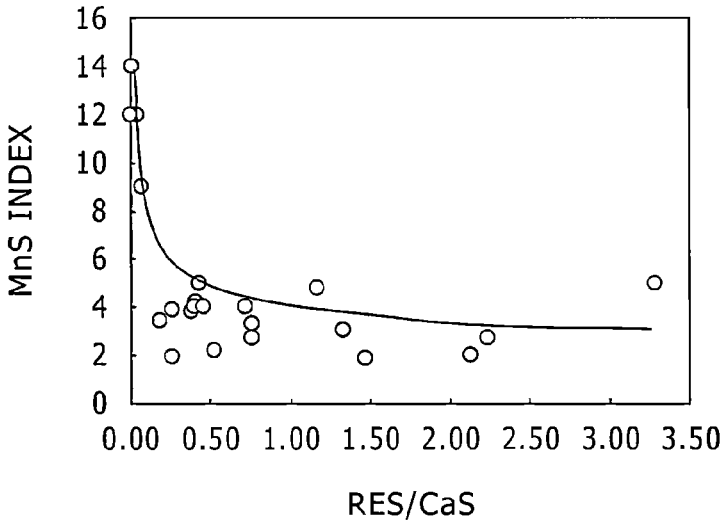
FIG. 2 is a graph showing a relationship between a RES/Cas and a MnS index.

FIG. 2 shows a graph of the relationship between RES/CaS and MnS index, which is the result of Examples to be described later. The above MnS index is calculated by multiplying a Mn content of the inclusions by a value of (molecular weight of MnS)/(atomic weight of Mn), based on the assumption that all elements of Mn contained in the inclusions exist in form of MnS.

As shown in FIG. 2, RES/CaS is set to 0.05 or more, which drastically decreases the MnS index, that is, drastically reduces the formation of MnS.

FIG. 2 shows the result of examination of the relationship between the RES/CaS and MnS index on the assumption that the Mn content and the S content are within respective defined ranges. When at least one of the Mn content and the S content is excessive, even the control of the RES/CaS would form the excessive MnS to cause the HIC. The invention does not define the MnS content of the inclusion, but defines the Mn content and the S content of the steel within the respective defined ranges, while setting the RES/CaS to 0.05 or more to thereby sufficiently control the MnS content of the inclusion.

Figure 3:
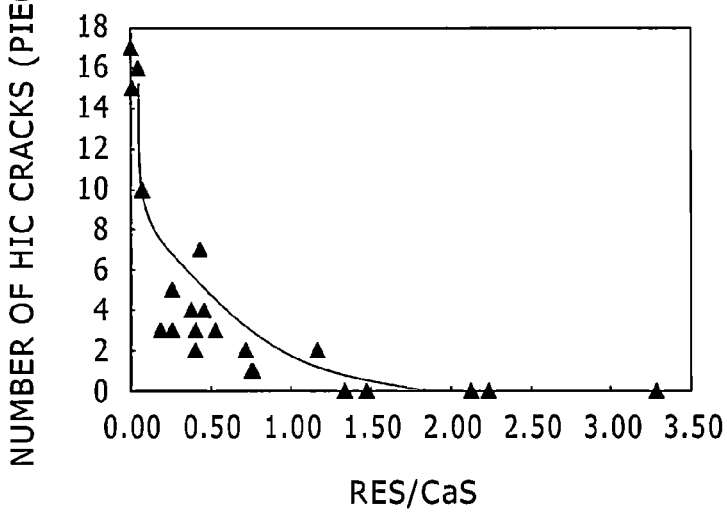
FIG. 3 is a graph showing a relationship between the RES/CaS and the number of HIC cracks having a width of 200 μm or more.

The relationship between the RES/CaS and the HIC resistance is also examined. FIG. 3 shows the graph of the relationship between the RES/CaS and the number of HIC cracks having a width of 200 μm or more. As can be seen from FIG. 3, for RES/CaS of 0.05 or more, the number of HIC cracks with the width of 200 μm or more drastically decreases, so that the excellent HIC resistance can be obtained.

By comparison between FIGS. 2 and 3, the RES/CaS is set to 0.05 or more, which reduces the formation of the MnS. Further, as the ratio of RES to CaS increases, the hydrogen induced cracking resistance is improved. This is because the coefficient of thermal expansion of the sulfide contained in the inclusion is decreased, which will result in improvement of the hydrogen induced cracking resistance.

The RES/CaS is preferably 0.10 or more, more preferably 0.50 or more, and most preferably 1.0 or more.

As the RES/CaS becomes more, the HIC resistance is improved. Thus, the upper limit of the RES/CaS is not set from the viewpoint of improvement of the HIC resistance. However, as the RES/CaS is increased, the above effect will be saturated as shown in FIGS. 2 and 3. A dipping nozzle tends to be closed during casting. In order to prevent the closing of the nozzle to improve the productivity, the RES/CaS is preferably 2.0 or less, and more preferably 1.5 or less.

The reason for defining the Zr content of the inclusion will be described below.

The invention sets the specific range (Zr content of the inclusion to 60% or less to be described later), so that the Zr element hardly forms a carbide, a nitride, or a sulfide. As the Zr content of the inclusion is increased, a $ZrO_2$ content of the inclusion is increased, which results in a small thermal expansion coefficient of the inclusion to thereby improve the hydrogen induced cracking resistance. The invention defines the Zr content of the inclusion. For the Zr content of the inclusion of 5% or more, the excellent hydrogen induced cracking resistance can be obtained. Thus, the Zr content of the inclusion is preferably 7% or more, and more preferably 10% or more.

In contrast, as will be described later, the excessive Zr content of the inclusion tends to form Nb (C, N) having a large thermal expansion coefficient, which degrades the hydrogen induced cracking resistance.

That is, Table 1 does not show the thermal expansion coefficients of carbides and nitrides. For example, the thermal expansion coefficient of NbC is $51.82\times10^{-6}$/K, which is very large as compared to, for example, TiC ($7.4\times10^{-6}$/K) or TiN ($7.75\times10^{-6}$/K). The Nb(C, N) containing NbC is also likely to act as a starting point of the HIC because of its high thermal expansion coefficient.

The above Nb(C, N) tends to form an inclusion having good compatibility with Nb(C, N) as a formation nucleus. The formation nucleus is, for example, Zr(C, N). When the Zr content of the inclusion becomes excessive, the above Zr(C, N) other than a desired $ZrO_2$ are generated in a great amount even after the control of a slag composition, which leads to the formation of Nb(C, N) as a result.

The form of Nb existing in the inclusion in the related art includes Nb (composite inclusion) crystallized as a carbide or the like together with Zr so as to enclose the oxide or sulfide, in addition to the above Nb(C, N). For example, this form corresponds to a steel in a comparative example shown in FIG. 4.

Figure 4:
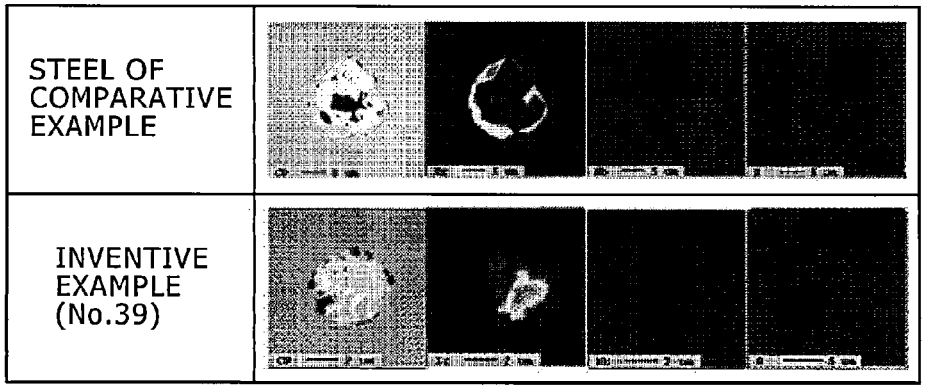
FIG. 4 is a microphotograph showing analysis results of inclusion compositions of the steel (inventive example) of the present invention and of a comparative example.

FIG. 4 represents the comparison of the analysis results between the inclusion of the steel of the invention (inventive example) and the inclusion of the steel of the comparative example, which were obtained by measurement with electron probe micro analysis (EPMA). As to each steel, a composition image, a Zr distribution, a Nb distribution, and a N distribution provided by the EPMA are shown in that order from the left side of a photograph. As can be seen from FIG. 4, in the invention (inventive example), the steel has Zr existing in the inclusion, and hardly has Nb detected. In contrast, in the comparative example, the steel has Zr existing on the surface of the inclusion (composite inclusion) not containing Zr therein, and Nb existing thinly on the surface of the inclusion (that is, a Zr—Nb crystallized layer formed thereon).

The composite inclusion also degrades the HIC resistance as will be described below.

A thermal expansion coefficient of the Zr—Nb crystallized layer in the composite inclusion is more than that of an oxide/sulfide forming a nucleus of the composite inclusion because of the presence of NbC having a high thermal expansion coefficient. Further, since the Zr—Nb crystallized layer has a smaller plastic deformation capacity than that of the oxide/sulfide, the thermal expansion coefficient of the composite inclusion depends on the thermal expansion coefficient of the above Zr—Nb crystallized layer. As a result, the composite inclusion acts as an inclusion having a high thermal expansion coefficient to degrade the HIC resistance.

In order to eliminate the Nb(C, N) and the composite inclusion which might degrade the HIC resistance in this way, the invention sets the Zr content of the inclusion to 60% or less, preferably 50% or less, and more preferably 35% or less. The Nb content of the inclusion is set to 5% or less (including 0%). The Nb content of the inclusion is preferably 3% or less, and more preferably 2% or less.

The composition of the above inclusion is configured such that the thermal expansion coefficient of the inclusion is substantially the same as that of the base phase. Even when a void is formed at an interface between the base phase and the inclusion, a tensile residual stress hardly occurs in the base phase around the inclusion, which can exhibit the effect of suppressing the hydrogen induced cracking which would be caused by the tensile stress.

The composition of the above inclusion is determined by a method described in the following Examples.

In order to ensure other good properties, including excellent HAZ toughness and weldability, as well as the excellent HIC resistance, together with the composition of the inclusion set in the above range, it is necessary to set the component composition of the steel plate as follows. The reason for defining each component will be described below.

[Component Composition]

[C: 0.02 to 0.20%]

The element C is an element essential to ensure the strength of the base metal and weld bead. The C content needs to be 0.02% or more, preferably 0.03% or more, and more preferably 0.05% or more.

The much higher C content degrades the HAZ toughness and weldability. The excessive C content tends to easily form NbC and also an island-like martensite, which act as a starting point of HIC to make a breaking route. Thus, the C content needs to be 0.20% or less, preferably 0.15% or less, and more preferably 0.12% or less.

[Si: 0.02 to 0.50%]

The element Si has effects of deoxidizing while improving the strength of the base metal and weld bead. In order to obtain these effects, the Si content is 0.02% or more, preferably 0.05% or more, and more preferably 0.15% or more. However, the much higher Si content degrades the weldability and toughness. The excessive Si content generates the island-like martensite to cause and promote the HIC. Thus, the Si content needs to be reduced to 0.50% or less. The Si content is preferably 0.45% or less, and more preferably 0.35% or less.

[Mn: 0.6 to 2.0%]

The element Mn is an element useful for improving the strength of the base metal and weld bead. In the invention, the Mn content is 0.6% or more. The Mn content is preferably 0.8% or more, and more preferably 1.0% or more. The much higher Mn content forms MnS to degrade the hydrogen induced cracking resistance, and also degrade the HAZ toughness and weldability. The upper limit of Mn content is 2.0% or less, preferably 1.8% or less, and more preferably 1.6% or less.

[P: 0.030% or Less]

The element P is an element inevitably contained in the steel. For the P content of more than 0.030%, the base metal and the HAZ toughness are drastically degraded to reduce the hydrogen induced cracking resistance. Thus, in the invention, the P content is reduced to 0.030% or less, preferably 0.020% or less, and more preferably 0.010% or less.

[S: 0.004% or Less]

The higher S content forms MnS in a large amount to drastically degrade the hydrogen induced cracking resistance. In the invention, the upper limit of S content is 0.004%. The S content is preferably 0.003% or less, more preferably 0.0025% or less, and most preferably 0.0020% or less. From the viewpoint of improving the hydrogen induced cracking resistance, the S content is preferably small. It is difficult to set the S content to less than 0.0001% in terms of industry.

[Al: 0.010 to 0.08%]

The element Al is an element that serves as a strong deoxidizer. When the Al content is small, REM tends to become an oxide on a priority basis over Al, which makes it difficult to obtain the RES in a desired amount. As a result, it is difficult to set the RES/CaS constant. In the invention, the Al content needs to be 0.010% or more. The Al content is preferably 0.020% or more, and more preferably 0.030% or more.

The much higher Al content preferentially forms an Al oxide rather than a Zr oxide to reduce the Zr content of the inclusion. The Al oxides are generated in the form of cluster, which acts as the starting point of the hydrogen induced cracking. Thus, the Al content needs to be 0.08% or less. The Al content is preferably 0.06% or less, and more preferably 0.05% or less.

[N: 0.001 to 0.01%]

The element N forms TiN. The deposition of TiN in a steel structure suppresses coarsening of austenite grains of a HAZ part to promote ferrite transformation, thus improving the toughness of the HAZ part. In order to obtain such an effect, the N content needs to be 0.001% or more, preferably 0.003% or more, and more preferably 0.0040% or more. The much higher N content degrades the HAZ toughness due to the presence of solid N. Thus, the N content needs to be 0.01% or less, preferably, 0.008% or less, and more preferably 0.0060% or less.

[Nb: 0.002 to 0.06%]

The element Nb is an element useful for improving the strength of the steel and the toughness of the base metal without degrading the weldability. In order to obtain these effects, the Nb content needs to be 0.002% or more. The Nb content is preferably 0.010% or more, and more preferably 0.020% or more. For the Nb content exceeding 0.06%, the Nb content of the inclusion becomes high, which degrades the toughness of the base metal and HAZ. In the invention, the upper limit of Nb content is set to 0.06%. The Nb content is preferably 0.050% or less, more preferably 0.040% or less, and most preferably 0.030% or less.

[Ca: 0.0003 to 0.0060%]

The element Ca has an effect of controlling the form of a sulfide. The formation of CaS has an effect of suppressing the formation of MnS. In order to obtain this effect, the Ca content needs to be 0.0003% or more, preferably 0.0005% or more, and more preferably 0.0010%. For the Ca content exceeding 0.0060%, the rate of CaS occupying the formed sulfides is increased, which makes it difficult to obtain a desired RES to degrade the HIC resistance. In the invention, the upper limit of Ca content is 0.0060%. The Ca content is preferably 0.005% or less, and more preferably 0.0040% or less.

[O: 0.0040% or Less]

The O (oxygen) content is desirably low from the viewpoint of improving cleanliness. The much high O content degrades the toughness of the steel, and HIC is caused from an oxide as a starting point, which degrades the hydrogen induced cracking resistance. From this point, the O content needs to be 0.0040% or less, preferably 0.0030%, and more preferably 0.0020% or less.

[REM: 0.0002 to 0.05%]

The element REM (rare earth) is the most important element in the invention. As mentioned above, the REM is very useful for improving the hydrogen induced cracking resistance by satisfying the relationship of RES/CaS≥0.05 in the composition of an inclusion of the steel. In order to exhibit such an effect, the REM content needs to be 0.0002% or more. The REM content is preferably 0.0005% or more, and more preferably 0.0010% or more. Even the much high REM content saturates the effect. The upper limit of the REM content is 0.05%. From the viewpoint of suppressing closing of the dip nozzle upon casting to improve the productivity, the REM content is preferably 0.03% or less, more preferably, 0.010% or less, and most preferably 0.0050% or less.

In the invention, the above REM means lanthanoids (15 elements from La to Lu in a periodic table), Sc (scandium), and Y.

[Zr: 0.0003 to 0.020%]

The element Zr can form $ZrO_2$ as an oxide and decrease a coefficient of thermal expansion of the oxide, as mentioned above. In order to set the concentration of Zr in the inclusion to 5% or more so as to drastically improve the hydrogen induced cracking resistance, the Zr content of the steel needs to be 0.0003% or more. The Zr content is preferably 0.0005% or more, more preferably 0.0010% or more, and most preferably 0.0015% or more. The excessive addition of Zr increases the amount of solid Zr. The solid Zr is crystallized together with Nb to enclose the oxide and sulfide during the casting process, like the composite inclusion of the steel in the comparative example shown in FIG. 4, which degrades the hydrogen induced cracking resistance. Thus, the Zr content needs to 0.020% or less. The Zr content is preferably 0.010% or less, more preferably 0.0070% or less, and most preferably 0.0050% or less.

The components of the steel of the invention are those described above with the remainder or balance being iron and inevitable impurities. In addition to the above elements, the steel of the invention can contain one or more kinds of elements selected from the group consisting of Ti, B, V, Cu, Ni, Cr, Mo, and Mg to thereby improve the HAZ toughness and the strength of the steel. Now, these elements will be described in detail below.

[Ti: 0.003 to 0.03%]

The element Ti is deposited in the form of TiN in the steel to prevent the coarsing of austenite grains in a HAZ part during welding and promote the ferrite transformation, thus improving the toughness of the HAZ part. In order to obtain such an effect, the Ti content is preferably 0.003% or more, more preferably 0.005% or more, and most preferably 0.010% or more. The excessive Ti content causes the solid Ti and TiC to be deposited, which degrades the toughness of the base metal and HAZ part. Thus, the Ti content is preferably 0.03% or less, and more preferably 0.02% or less.

[B: 0.0002 to 0.005%]

The element B enhances the quenching property to increase the strength of the base metal and weld bead. While the heated HAZ part is cooled in welding, the HAZ part is bonded with N to generate the precipitation of BN, and to promote the ferrite transformation in the austenite grains, which improves the HAZ toughness. In order to obtain such an effect, the B content is preferably 0.0002% or more, more preferably 0.0005% or more, and most preferably 0.0010% or more. The excessive B content degrades the toughness of the base metal and the HAZ part, and also degrades the weldability. The B content is preferably 0.005% or less, more preferably 0.004% or less, and most preferably 0.0030% or less.

[V: 0.003 to 0.1%]

The element V is an element useful for improving the strength of the steel. In order to obtain such an effect, the V content is preferably 0.003% or more, and more preferably 0.010% or more. For the V content exceeding 0.1%, the weldabilty of the steel and the toughness of the base metal are degraded. Thus, the V content is preferably 0.1% or less, and more preferably 0.08% or less.

[Cu: 0.01 to 1.5%]

The element Cu is an element useful for improving the quenching property to increase the strength of the steel. In order to obtain such an effect, the Cu content is preferably 0.01% or more, more preferably 0.05% or more, and most preferably 0.10% or more. For the Cu content exceeding 1.5%, however, the toughness of the steel is degraded. The Cu content is preferably 1.5% or less, more preferably 1.0% or less, and most preferably 0.50% or less.

[Ni: 0.01 to 3.5%]

The element Ni is an element useful for improving the strength and toughness of the base metal and weld bead. In order to obtain such an effect, the Ni content is preferably 0.01% or more, more preferably 0.05% or more, and most preferably 0.10% or more. The much higher Ni content makes the steel for the structure very expensive. From the economical viewpoint, the Ni content is preferably 3.5% or less, more preferably 1.5% or less, further more preferably 1.0% or less, and most preferably 0.50% or less.

[Cr: 0.01 to 1.5%]

The element Cr is an element useful for improving the strength of the steel. In order to obtain such an effect, the Cr content is preferably 0.01% or more, more preferably 0.05% or more, and most preferably 0.10% or more. For the Cr content exceeding 1.5%, the HAZ toughness is degraded. Thus, the Cr content is preferably 1.5% or less, more preferably 1.0% or less, and most preferably 0.50% or less.

[Mo: 0.01 to 1.5%]

The element Mo is an element useful for improving the strength and toughness of the base metal. In order to obtain such an effect, the Mo content is preferably 0.01% or more, more preferably 0.05% or more, and most preferably 0.10% or more. For the Mo content exceeding 1.5%, the HAZ toughness and the weldability are degraded. Thus, the Mo content is preferably 1.5% or less, more preferably 1.0% or less, and most preferably 0.50% or less.

[Mg: 0.0003 to 0.005%]

The element Mg is an element useful for improving the toughness of the steel through miniaturization of crystal grains. In order to obtain such an effect, the Mg content is preferably 0.0003% or more, and more preferably 0.001% or more. In contrast, for the Mg content exceeding 0.005%, the effect is saturated. Thus, the upper limit of the Mg content is preferably 0.005%. The Mg content is more preferably 0.0030% or less.

[Manufacturing Method]

In order to obtain the steel plate with the above composition in the present invention, a smelting process includes the steps of:

(A) desulfurizing by use of a slag having a Fe content in a range of 0.1 to 10% so as to set a S content to 0.004% or less;

(B) deoxidizing such that a ratio (Of/S) of a dissolved-oxygen (Of) content of a molten steel to a S content of the molten steel is equal to or less than 10; and (C) adding Zr, REM, and Ca in that order, or adding both Zr and REM at the same time and then adding Ca (note that a time period from the addition of the REM to the addition of Ca being set to 4 minutes or more), the above steps being performed in that order;

in which a time period from the addition of Ca to completion of solidification needs to be within 200 minutes.

The above respective steps will be described below in turn.

(A) Desulfurization Step

In a steel converter or an electric furnace, a desulfurization process is performed on a molten steel melted at a temperature of 1550° C. or more, using a slag having a Fe content in a range of 0.1 to 10%, which reduces the S content to 0.004% or less.

By increasing the Fe content of the slag, the element Zr added in and after the desulfurization step can preferentially form oxides without being solid-soluble in the molten steel. As a result, an Nb-containing layer (see the composite inclusion of the steel in the above comparative example shown in FIG. 4) which would be formed to cover the inclusion together with Zr in casting is reduced, which can decrease the Nb content of the inclusion.

In order to obtain such an effect, the Fe content of the slag is 0.1% or more. The Fe content of the slag is preferable 0.5% or more, more preferably, 1.0% or more.

For the Fe content of the slag exceeding 10%, the oxides are formed in a higher amount. The oxide not only acts as a starting point of the hydrogen induced cracking, but also degrades the toughness of the base metal and weld heat-affected zone. Thus, the Fe content of the slag is 10% or less, more preferably 8% or less, and most preferably 5% or less.

The desulfurization process is sufficiently performed to suppress the S content to 0.004% or less, which can prevent CaS from being formed in a higher amount upon addition of Ca after addition of the REM, and thus can appropriately control the RES/CaS.

The ways to reduce the S content to 0.004% or less include the following (a) and (b).

(a) The CaO content of the above slag is 10% or more.

The CaO of the slag reacts with dissolved S of the molten steel into CaS, which can reduce the S content of the molten steel, that is, can sufficiently perform desulfurization. The CaO content of the slag is set to 10% or more, which serves as means for reducing the S content to 0.004% or less. The CaO content of the slag is preferable 15% or more, and more preferably 20% or more. The excessive CaO content of the slag makes the desulfurization process difficult. The upper limit of CaO content is about 80%.

(b) For example, the desulfurization process is performed by stirring for three minutes or more (preferably 10 minutes or more, more preferably 20 minutes or more, the upper limit time period being about 200 minutes from the viewpoint of productivity), while blowing thereinto inert gas (Ar and the like) at a flow rate of 5 Nm/h or more (preferably, 10 Nm/h or more, the upper limit of flow rate being about 300 Nm/h) using a ladle desulfurzer (for example, ladle furnace).

(B) Deoxidation Step

In this process, before addition of REM to be described later, the ratio of the content of dissolved oxygen "Of" in the molten steel to the S content of the molten steel, namely, Of/S is set to equal to or less than 10.

The REM forms an oxide as well as a sulfide when being added to the molten steel. For the Of/S exceeding 10, most of added REM forms oxides, so that the amount of formed RES becomes insufficient. As a result, the higher amount of CaS is generated, so that the ratio of RES/CaS is not within a proper range, which degrades the hydrogen induced cracking resistance. In the invention, as mentioned above, the ratio of Of/S is set to 10 or less. The Os/S is preferably 5 or less, more preferably 3.5 or less, and most preferably 2.0 or less. The lower limit of Of/S is about 0.1.

In order to set the above Of/S to 10 or less, a deoxidizing element, such as Al, Mn, Si, or Ti, is added, and/or for example, an RH degassing device is used for the deoxidization.

(C) Addition Step of Zr, REM, and Ca

By comparison of the desulfurizing capacity between REM and Ca, the desulfurizing capacity of REM is smaller than that of Ca. The addition of Ca before addition of REM makes it difficult to preferentially form RES rather than CaS. Thus, it is necessary to add REM before the addition of Ca. In order to sufficiently form RES, the time period from the addition of REM to the addition of Ca needs to be 4 minutes or more. The time period from the addition of REM to the addition of Ca is preferably 5 minutes or more, and more preferably 8 minutes or more. The upper limit of the time period from the addition of REM to the addition of Ca is about 60 minutes from the viewpoint of productivity.

Likewise, by comparison of the deoxidizing capacity among Zr, REM, and Ca, generally, Ca has the largest deoxidizing capacity, and the relationship among the deoxidizing capacities of Zr, REM, and Ca is as follows: Ca>REM>Zr. And, Zr has the smallest deoxidizing capacity. In order to contain Zr in the inclusion (that is, to form $ZrO_2$ as an oxide inclusion), Zr has to be added before addition of Ca or REM which has a stronger deoxidizing capacity than that of Zr. Since REM has a small deoxidizing capacity as compared to Ca, the addition of REM at the same time as the addition of Zr can also cause the inclusion to contain Zr.

Taking into consideration the desulfurizing capacities and deoxidizing capacities of Zr, REM, and Ca, the elements Zr, REM, and Ca are added in that order. Alternatively, the elements Zr and REM may be added at the same time, and then Ca may be added thereto (note that the time period from the addition of REM to the addition of Ca is 4 minutes or more).

Any amount of addition of each element is allowable as long as a steel plate containing a desired corresponding amount of each element is obtained. For example, Zr is added such that the Zr content of the molten steel is in a range of 3 to 200 ppm (0.0003 to 0.020%). Thereafter or at the same time, REM is added such that the REM content of the molten steel is in a range of 2 to 500 ppm (0.0002 to 0.05%). After 4 minutes have elapsed, Ca is added such that the Ca content of the molten steel is in a range of 3 to 60 ppm (0.0003 to 0.0060%).

After the addition of Ca, casting is quickly started (for example, within 80 minutes), whereby the casting is performed such that a time period from the addition of Ca to the completion of solidification is 200 minutes or less. The reason for this is as follows.

That is, the element Ca is an element with high desulfurizing capacity and deoxidizing capacity. As the time has passed after the addition of Ca, RES and $ZrO_2$ tend to be formed into stable compounds, such as CaS or CaO, whereby the RES/CaS and the Zr content of the inclusion cannot be controlled within predetermined respective ranges. Accordingly, in the invention, the time period from the addition of Ca until completion of solidification is set to 200 minutes or less, preferably, 180 minutes or less, and more preferably 160 minutes or less. The lower limit of the above-mentioned time is about 4 minutes from the viewpoint of homogenizing the state of Ca.

After the solidification, hot rolling is performed by a normal method, so that the steel plate can be manufactured. Then, the steel plate can be used to manufacture a steel pipe suitable for use in a line pipe by a generally-used method.

EXAMPLES

Now, the invention will be specifically described referring to examples. However, it is apparent that the invention is not limited to the following examples, and that various modifications and changes can be made to the invention within the scope of invention described above and later, any of which belongs to the technical range of the invention.

In a steel converter, a slag having a CaO content and a Fe content shown in Table 4 was charged into a molten steel melted at a temperature of 1550 to 1700° C. Then, in a ladle furnace, the molten steel was stirred for the time indicated by Table 4 while blowing Ar gas into the furnace at a flow rate shown in Table 4, so that the S content of the steel was controlled according to Table 2 or 3. Thereafter, Al was added to have the target composition of Al (indicated by Table 2 or 3) and reflux was performed by a RH degassing device for 3 minutes or more, so that the ratio Of/S was controlled to the value shown in Table 4.

Next, REM was added to have the target composition of REM (indicated by Table 2 or 3) (specifically, Zr is added in prior to the addition of REM, or at the same time as the addition of REM). Then, the reflux was further performed by the RH degassing device for 3 to 40 minutes, and Ca was added to have the target composition of Ca (indicated by Table 2 or 3). After the addition of Ca, casting was started in 30 to 80 minutes, whereby a slab having a thickness of 280 mm was manufactured. The time period from the addition of Ca to the completion of solidification was indicated by Table 4.

In a specimen No. 43 as a comparative example, REM, Zr, and Ca were not added in that order, and after the addition of Ca, Zr and REM were added.

Then, after re-heating the above slab at a temperature of 1050 to 1250° C., the steel plate was subjected to hot rolling such that a cumulative draft at a surface temperature of the steel plate of 900° C. or more was equal to or more than 30%. Thereafter, the hot rolling was further performed such that the cumulative draft at a temperature of 700° C. or more, and less than 900° C. was equal to or more than 20%, and such that the temperature of the end of the rolling was 700° C. or more, and less than 900° C. Then, water-cooling was started from the temperature of 650° C. or more and stopped at a temperature of 350 to 600° C. Then, water-cooling was further performed up to the room temperature, which resulted in steel plates with various compositions of components and inclusions (thickness shown in Table 5 or 6×2000 to 3500 mm in width×12000 to 35000 mm in length).

In Examples, one or more of La, Ce, Nd, Dy, and Y was used as the REM.

TABLE 2

| | Chemical component composition (% by mass), remainder being iron and inevitable impurities | | | | | | | | | | | | | | | | | | | |
|---|---|---|---|---|---|---|---|---|---|---|---|---|---|---|---|---|---|---|---|---|
| No. | C | Si | Mn | P | S | Al | Cu | Ni | Cr | Mo | V | Nb | Ti | B | Ca | N | O | Zr | REM | Mg |
| 1 | 0.12 | 0.35 | 1.50 | 0.007 | 0.0010 | 0.030 | 0 | 0 | 0 | 0 | 0 | 0.025 | 0 | 0 | 0.0015 | 0.0045 | 0.0012 | 0 | 0 | 0 |
| 2 | 0.12 | 0.35 | 1.50 | 0.007 | 0.0010 | 0.030 | 0 | 0 | 0 | 0 | 0 | 0.025 | 0 | 0 | 0.0015 | 0.0045 | 0.0012 | 0.0015 | 0.0001 | 0 |
| 3 | 0.12 | 0.05 | 1.50 | 0.007 | 0.0002 | 0.030 | 0 | 0 | 0 | 0 | 0 | 0.025 | 0 | 0 | 0.0015 | 0.0045 | 0.0010 | 0.0015 | 0.0005 | 0 |
| 4 | 0.12 | 0.35 | 1.50 | 0.007 | 0.0005 | 0.030 | 0 | 0 | 0 | 0 | 0 | 0.025 | 0 | 0 | 0.0015 | 0.0045 | 0.0016 | 0.0015 | 0.0040 | 0 |
| 5 | 0.12 | 0.35 | 1.50 | 0.007 | 0.0010 | 0.030 | 0 | 0 | 0 | 0 | 0 | 0.025 | 0 | 0 | 0.0004 | 0.0045 | 0.0010 | 0.0015 | 0.0080 | 0 |
| 6 | 0.12 | 0.35 | 1.50 | 0.007 | 0.0010 | 0.030 | 0 | 0 | 0 | 0 | 0 | 0.025 | 0 | 0 | 0.0015 | 0.0045 | 0.0018 | 0.0015 | 0.0310 | 0 |
| 7 | 0.07 | 0.20 | 1.00 | 0.007 | 0.0030 | 0.030 | 0 | 0 | 0 | 0 | 0 | 0.025 | 0 | 0 | 0.0015 | 0.0045 | 0.0012 | 0.0015 | 0 | 0 |
| 8 | 0.07 | 0.45 | 1.00 | 0.007 | 0.0005 | 0.030 | 0 | 0 | 0 | 0 | 0 | 0.025 | 0 | 0 | 0.0015 | 0.0045 | 0.0010 | 0.0015 | 0.0010 | 0 |
| 9 | 0.07 | 0.20 | 1.00 | 0.007 | 0.0040 | 0.030 | 0 | 0 | 0 | 0 | 0 | 0.025 | 0 | 0 | 0.0015 | 0.0045 | 0.0016 | 0.0015 | 0.0040 | 0 |
| 10 | 0.07 | 0.20 | 1.00 | 0.007 | 0.0030 | 0.030 | 0 | 0 | 0 | 0 | 0 | 0.025 | 0 | 0 | 0.0015 | 0.0045 | 0.0010 | 0.0015 | 0.0170 | 0 |
| 11 | 0.07 | 0.20 | 1.00 | 0.007 | 0.0030 | 0.030 | 0 | 0 | 0 | 0 | 0 | 0.025 | 0 | 0 | 0.0015 | 0.0045 | 0.0018 | 0.0015 | 0.0310 | 0 |

TABLE 2-continued

| No. | Chemical component composition (% by mass), remainder being iron and inevitable impurities | | | | | | | | | | | | | | | | | | | |
|---|---|---|---|---|---|---|---|---|---|---|---|---|---|---|---|---|---|---|---|---|
| | C | Si | Mn | P | S | Al | Cu | Ni | Cr | Mo | V | Nb | Ti | B | Ca | N | O | Zr | REM | Mg |
| 12 | 0.12 | 0.35 | 1.50 | 0.007 | 0.0020 | 0.030 | 0 | 0 | 0 | 0 | 0 | 0.025 | 0 | 0 | 0.0015 | 0.0045 | 0.0011 | 0.0015 | 0.0015 | 0 |
| 13 | 0.12 | 0.35 | 1.50 | 0.007 | 0.0020 | 0.060 | 0 | 0 | 0 | 0 | 0 | 0.025 | 0 | 0 | 0.0015 | 0.0045 | 0.0012 | 0.0035 | 0.0015 | 0 |
| 14 | 0.12 | 0.35 | 1.50 | 0.007 | 0.0020 | 0.030 | 0 | 0 | 0 | 0 | 0 | 0.025 | 0 | 0 | 0.0015 | 0.0045 | 0.0013 | 0.0070 | 0.0020 | 0 |
| 15 | 0.12 | 0.35 | 1.50 | 0.007 | 0.0005 | 0.030 | 0 | 0 | 0 | 0 | 0 | 0.025 | 0 | 0 | 0.0015 | 0.0045 | 0.0013 | 0.0015 | 0.0040 | 0 |
| 16 | 0.12 | 0.35 | 1.50 | 0.007 | 0.0020 | 0.030 | 0 | 0 | 0 | 0 | 0 | 0.025 | 0 | 0 | 0.0015 | 0.0045 | 0.0013 | 0.0220 | 0.0020 | 0 |
| 17 | 0.07 | 0.20 | 1.00 | 0.007 | 0.0020 | 0.030 | 0 | 0 | 0 | 0 | 0 | 0.025 | 0 | 0 | 0.0005 | 0.0045 | 0.0011 | 0.0015 | 0.0015 | 0 |
| 18 | 0.04 | 0.20 | 0.65 | 0.007 | 0.0020 | 0.030 | 0 | 0 | 0 | 0 | 0 | 0.025 | 0 | 0 | 0.0015 | 0.0045 | 0.0012 | 0.0035 | 0.0015 | 0 |
| 19 | 0.07 | 0.20 | 1.00 | 0.025 | 0.0005 | 0.030 | 0 | 0 | 0 | 0 | 0 | 0.025 | 0 | 0 | 0.0041 | 0.0045 | 0.0013 | 0.0070 | 0.0020 | 0 |
| 20 | 0.15 | 0.20 | 1.00 | 0.007 | 0.0020 | 0.030 | 0 | 0 | 0 | 0 | 0 | 0.005 | 0 | 0 | 0.0015 | 0.0045 | 0.0013 | 0.0015 | 0.0040 | 0 |
| 21 | 0.07 | 0.20 | 1.00 | 0.007 | 0.0020 | 0.030 | 0 | 0 | 0 | 0 | 0 | 0.025 | 0 | 0 | 0.0015 | 0.0045 | 0.0013 | 0.0250 | 0.0020 | 0 |
| 22 | 0.07 | 0.20 | 1.00 | 0.007 | 0.0002 | 0.030 | 0 | 0 | 0 | 0 | 0 | 0.025 | 0 | 0 | 0.0015 | 0.0045 | 0.0013 | 0.0020 | 0.0100 | 0 |
| 23 | 0.23 | 0.20 | 1.00 | 0.007 | 0.0020 | 0.030 | 0 | 0 | 0 | 0 | 0 | 0.025 | 0 | 0 | 0.0015 | 0.0045 | 0.0016 | 0.0020 | 0.0040 | 0 |
| 24 | 0.07 | 0.20 | 2.20 | 0.007 | 0.0020 | 0.030 | 0 | 0 | 0 | 0 | 0 | 0.025 | 0 | 0 | 0.0015 | 0.0045 | 0.0016 | 0.0020 | 0.0040 | 0 |
| 25 | 0.07 | 0.20 | 1.50 | 0.007 | 0.0050 | 0.030 | 0 | 0 | 0 | 0 | 0 | 0.025 | 0 | 0 | 0.0015 | 0.0045 | 0.0016 | 0.0020 | 0.0040 | 0 |

TABLE 3

| No. | Chemical component composition (% by mass), remainder being iron and inevitable impurities | | | | | | | | | |
|---|---|---|---|---|---|---|---|---|---|---|
| | C | Si | Mn | P | S | Al | Cu | Ni | Cr | Mo |
| 26 | 0.07 | 0.20 | 1.50 | 0.037 | 0.0020 | 0.030 | 0 | 0 | 0 | 0 |
| 27 | 0.07 | 0.65 | 1.50 | 0.007 | 0.0020 | 0.030 | 0 | 0 | 0 | 0 |
| 28 | 0.07 | 0.20 | 1.50 | 0.007 | 0.0020 | 0.005 | 0 | 0 | 0 | 0 |
| 29 | 0.07 | 0.20 | 1.50 | 0.007 | 0.0020 | 0.030 | 0 | 0 | 0 | 0 |
| 30 | 0.07 | 0.20 | 1.50 | 0.007 | 0.0020 | 0.030 | 0 | 0 | 0 | 0 |
| 31 | 0.07 | 0.20 | 1.50 | 0.007 | 0.0020 | 0.100 | 0 | 0 | 0 | 0 |
| 32 | 0.07 | 0.20 | 1.50 | 0.007 | 0.0020 | 0.030 | 0 | 0 | 0 | 0 |
| 33 | 0.07 | 0.20 | 1.00 | 0.007 | 0.0005 | 0.030 | 0.20 | 0 | 0 | 0 |
| 34 | 0.07 | 0.20 | 1.00 | 0.007 | 0.0005 | 0.030 | 0 | 0.20 | 0 | 0 |
| 35 | 0.07 | 0.20 | 1.00 | 0.007 | 0.0005 | 0.030 | 0 | 0 | 0.15 | 0 |
| 36 | 0.07 | 0.20 | 1.00 | 0.007 | 0.0005 | 0.030 | 0 | 0 | 0 | 0.25 |
| 37 | 0.07 | 0.20 | 1.00 | 0.007 | 0.0005 | 0.030 | 0 | 0 | 0 | 0 |
| 38 | 0.07 | 0.20 | 1.00 | 0.007 | 0.0005 | 0.030 | 0 | 0 | 0 | 0 |
| 39 | 0.07 | 0.20 | 1.00 | 0.007 | 0.0005 | 0.030 | 0 | 0 | 0 | 0 |
| 40 | 0.07 | 0.20 | 1.00 | 0.007 | 0.0005 | 0.030 | 0 | 0 | 0 | 0 |
| 41 | 0.07 | 0.20 | 1.80 | 0.007 | 0.0005 | 0.030 | 0 | 0 | 0 | 0 |
| 42 | 0.07 | 0.20 | 1.00 | 0.007 | 0.0005 | 0.030 | 0 | 0 | 0 | 0 |
| 43 | 0.07 | 0.20 | 1.00 | 0.007 | 0.0005 | 0.030 | 0 | 0 | 0 | 0 |
| 44 | 0.07 | 0.20 | 1.00 | 0.007 | 0.0001 | 0.030 | 0 | 0 | 0 | 0 |
| 45 | 0.07 | 0.20 | 1.00 | 0.007 | 0.0005 | 0.030 | 0 | 0 | 0 | 0 |
| 46 | 0.07 | 0.20 | 1.00 | 0.007 | 0.0005 | 0.030 | 0 | 0 | 0 | 0 |
| 47 | 0.07 | 0.20 | 1.00 | 0.007 | 0.0045 | 0.030 | 0 | 0 | 0 | 0 |
| 48 | 0.07 | 0.20 | 1.00 | 0.007 | 0.0050 | 0.030 | 0 | 0 | 0 | 0 |
| 49 | 0.07 | 0.20 | 1.00 | 0.007 | 0.0005 | 0.030 | 0 | 0 | 0 | 0 |
| 50 | 0.07 | 0.20 | 1.00 | 0.007 | 0.0045 | 0.030 | 0 | 0 | 0 | 0 |

| No. | Chemical component composition (% by mass), remainder being iron and inevitable impurities | | | | | | | | | |
|---|---|---|---|---|---|---|---|---|---|---|
| | V | Nb | Ti | B | Ca | N | O | Zr | REM | Mg |
| 26 | 0 | 0.025 | 0 | 0 | 0.0015 | 0.0045 | 0.0016 | 0.0020 | 0.0040 | 0 |
| 27 | 0 | 0.025 | 0 | 0 | 0.0015 | 0.0045 | 0.0016 | 0.0020 | 0.0040 | 0 |
| 28 | 0 | 0.025 | 0 | 0 | 0.0015 | 0.0045 | 0.0016 | 0.0020 | 0.0040 | 0 |
| 29 | 0 | 0.025 | 0 | 0 | 0.0015 | 0.0045 | 0.0055 | 0.0020 | 0.0040 | 0 |
| 30 | 0 | 0.072 | 0 | 0 | 0.0015 | 0.0045 | 0.0016 | 0.0020 | 0.0040 | 0 |
| 31 | 0 | 0.025 | 0 | 0 | 0.0015 | 0.0045 | 0.0016 | 0.0020 | 0.0040 | 0 |
| 32 | 0 | 0.025 | 0 | 0 | 0.0001 | 0.0045 | 0.0016 | 0.0020 | 0.0040 | 0 |
| 33 | 0 | 0.025 | 0 | 0 | 0.0015 | 0.0045 | 0.0016 | 0.0020 | 0.0040 | 0 |
| 34 | 0 | 0.025 | 0 | 0 | 0.0015 | 0.0045 | 0.0016 | 0.0020 | 0.0040 | 0 |
| 35 | 0 | 0.025 | 0 | 0 | 0.0015 | 0.0045 | 0.0016 | 0.0020 | 0.0040 | 0 |
| 36 | 0 | 0.025 | 0 | 0 | 0.0015 | 0.0045 | 0.0016 | 0.0020 | 0.0040 | 0 |
| 37 | 0.05 | 0.025 | 0 | 0 | 0.0015 | 0.0045 | 0.0016 | 0.0020 | 0.0040 | 0 |
| 38 | 0 | 0.050 | 0 | 0 | 0.0015 | 0.0045 | 0.0016 | 0.0020 | 0.0040 | 0 |
| 39 | 0 | 0.025 | 0.015 | 0 | 0.0015 | 0.0045 | 0.0016 | 0.0020 | 0.0040 | 0 |
| 40 | 0 | 0.025 | 0 | 0.0015 | 0.0015 | 0.0045 | 0.0016 | 0.0020 | 0.0040 | 0 |
| 41 | 0 | 0.025 | 0 | 0 | 0.0015 | 0.0045 | 0.0016 | 0.0020 | 0.0040 | 0.0012 |
| 42 | 0 | 0.030 | 0 | 0 | 0.0015 | 0.0045 | 0.0016 | 0.0035 | 0.0040 | 0 |
| 43 | 0 | 0.025 | 0 | 0 | 0.0015 | 0.0045 | 0.0015 | 0.0015 | 0.0010 | 0 |
| 44 | 0 | 0.025 | 0 | 0 | 0.0015 | 0.0045 | 0.0014 | 0.0015 | 0.0010 | 0 |
| 45 | 0 | 0.025 | 0 | 0 | 0.0015 | 0.0045 | 0.0014 | 0.0015 | 0.0010 | 0 |
| 46 | 0 | 0.025 | 0 | 0 | 0.0015 | 0.0045 | 0.0016 | 0.0015 | 0.0010 | 0 |
| 47 | 0 | 0.025 | 0 | 0 | 0.0015 | 0.0045 | 0.0032 | 0.0015 | 0.0010 | 0 |

TABLE 3-continued

| | | | | | | | | | | |
|---|---|---|---|---|---|---|---|---|---|---|
| 48 | 0 | 0.025 | 0 | 0 | 0.0015 | 0.0045 | 0.0010 | 0.0015 | 0.0010 | 0 |
| 49 | 0 | 0.025 | 0 | 0 | 0.0015 | 0.0045 | 0.0010 | 0.0015 | 0.0010 | 0 |
| 50 | 0 | 0.025 | 0 | 0 | 0.0015 | 0.0045 | 0.0009 | 0.0015 | 0.0010 | 0 |

TABLE 4

| No | CaO content of slag (% by mass) | Fe content of slag (% by mass) | LF flow rate (Nm/h) | LF stirring time (minutes) | Of/S | Addition order of REM, Zr, and Ca | Time period from addition of REM to addition of Ca (minutes) | Time period from addition of Ca to completion of solidification (minutes) |
|---|---|---|---|---|---|---|---|---|
| 1 | 40 | 1.5 | 15 | 30 | 0.8 | REM, Zr→Ca | 10 | 140 |
| 2 | 40 | 1.5 | 15 | 30 | 0.4 | REM, Zr→Ca | 10 | 140 |
| 3 | 40 | 1.5 | 15 | 30 | 3.5 | REM, Zr→Ca | 10 | 180 |
| 4 | 40 | 1.5 | 15 | 30 | 1.2 | REM, Zr→Ca | 5 | 140 |
| 5 | 40 | 1.5 | 15 | 30 | 0.8 | REM, Zr→Ca | 10 | 140 |
| 6 | 40 | 1.5 | 15 | 30 | 0.7 | REM, Zr→Ca | 10 | 140 |
| 7 | 40 | 1.5 | 15 | 30 | 0.3 | REM, Zr→Ca | 10 | 140 |
| 8 | 40 | 1.5 | 15 | 30 | 1.9 | Zr→REM→Ca | 10 | 180 |
| 9 | 15 | 1.5 | 15 | 30 | 0.2 | REM, Zr→Ca | 10 | 140 |
| 10 | 40 | 1.5 | 15 | 30 | 0.2 | REM, Zr→Ca | 10 | 140 |
| 11 | 40 | 1.5 | 15 | 30 | 0.3 | REM, Zr→Ca | 10 | 140 |
| 12 | 40 | 1.5 | 15 | 30 | 0.3 | REM, Zr→Ca | 10 | 140 |
| 13 | 40 | 1.5 | 15 | 30 | 0.4 | REM, Zr→Ca | 10 | 140 |
| 14 | 40 | 1.5 | 15 | 30 | 0.4 | REM, Zr→Ca | 10 | 140 |
| 15 | 40 | 1.5 | 15 | 30 | 2.0 | REM, Zr→Ca | 10 | 140 |
| 16 | 40 | 1.5 | 15 | 30 | 0.4 | REM, Zr→Ca | 10 | 180 |
| 17 | 40 | 1.5 | 15 | 30 | 0.2 | REM, Zr→Ca | 10 | 140 |
| 18 | 40 | 8 | 15 | 30 | 0.3 | REM, Zr→Ca | 5 | 140 |
| 19 | 40 | 1.5 | 15 | 30 | 0.4 | REM, Zr→Ca | 10 | 140 |
| 20 | 40 | 1.5 | 15 | 30 | 0.4 | Zr→REM→Ca | 10 | 140 |
| 21 | 40 | 1.5 | 15 | 30 | 4.2 | REM, Zr→Ca | 10 | 180 |
| 22 | 40 | 1.5 | 15 | 30 | 0.4 | REM, Zr→Ca | 10 | 140 |
| 23 | 40 | 1.5 | 15 | 30 | 0.2 | REM, Zr→Ca | 10 | 140 |
| 24 | 40 | 1.5 | 15 | 30 | 0.1 | REM, Zr→Ca | 10 | 140 |
| 25 | 20 | 1.5 | 15 | 30 | 0.1 | REM, Zr→Ca | 5 | 140 |
| 26 | 40 | 1.5 | 15 | 30 | 0.2 | REM, Zr→Ca | 10 | 140 |
| 27 | 40 | 1.5 | 15 | 30 | 0.5 | Zr→REM→Ca | 10 | 140 |
| 28 | 40 | 1.5 | 15 | 30 | 0.6 | REM, Zr→Ca | 10 | 140 |
| 29 | 40 | 1.5 | 15 | 30 | 0.1 | REM, Zr→Ca | 10 | 140 |
| 30 | 40 | 1.5 | 15 | 30 | 0.2 | REM, Zr→Ca | 10 | 140 |
| 31 | 40 | 1.5 | 15 | 30 | 0.2 | REM, Zr→Ca | 10 | 140 |
| 32 | 40 | 1.5 | 15 | 30 | 0.2 | REM, Zr→Ca | 10 | 140 |
| 33 | 40 | 1.5 | 15 | 30 | 1.8 | REM, Zr→Ca | 10 | 180 |
| 34 | 40 | 1.5 | 15 | 30 | 1.4 | Zr→REM→Ca | 10 | 140 |
| 35 | 40 | 1.5 | 15 | 30 | 2.2 | REM, Zr→Ca | 10 | 140 |
| 36 | 40 | 1.5 | 15 | 30 | 0.9 | REM, Zr→Ca | 5 | 140 |
| 37 | 40 | 1.5 | 15 | 30 | 0.7 | REM, Zr→Ca | 10 | 140 |
| 38 | 40 | 1.5 | 15 | 30 | 1.7 | REM, Zr→Ca | 10 | 140 |
| 39 | 40 | 1.5 | 15 | 30 | 2.1 | REM, Zr→Ca | 10 | 140 |
| 40 | 40 | 1.5 | 15 | 30 | 0.9 | REM, Zr→Ca | 5 | 180 |
| 41 | 40 | 1.5 | 15 | 30 | 1.3 | REM, Zr→Ca | 10 | 140 |
| 42 | 40 | 1.5 | 15 | 30 | 2.0 | REM, Zr→Ca | 10 | 140 |
| 43 | 40 | 1.5 | 15 | 30 | 0.9 | Ca→Zr, REM | 10 | 180 |
| 44 | 40 | 1.5 | 15 | 30 | 12.0 | Zr→REM→Ca | 10 | 180 |
| 45 | 40 | 1.5 | 15 | 30 | 0.8 | Zr→REM→Ca | 10 | 260 |
| 46 | 40 | 1.5 | 15 | 30 | 1.9 | Zr→REM→Ca | 3 | 180 |
| 47 | 40 | 1.5 | 15 | 2 | 0.9 | Zr→REM→Ca | 10 | 180 |
| 48 | 40 | 1.5 | 3 | 30 | 2.1 | Zr→REM→Ca | 10 | 180 |
| 49 | 40 | 0.05 | 15 | 30 | 1.8 | Zr→REM→Ca | 10 | 180 |
| 50 | 8 | 1.5 | 15 | 30 | 2.0 | Zr→REM→Ca | 10 | 180 |

Using the obtained steel plates, the compositions of the inclusions were analyzed and the HIC resistance of specimens were evaluated as follows.

[Analysis of Compositions of Inclusions]

The compositions of the inclusions were analyzed in the following manner. That is, the section of a rolled material of each specimen in the thickness direction (with the section having the same thickness and width as those of the sheet) had its thickness-directional center observed with a device EPMA-8705 manufactured by Shimadzu Corporation. In details, three sections of each specimen were observed at a magnification of 400× with a field of view of about 50 $mm^2$ (7 mm in the thickness direction by 7 mm in the width direction with the thickness-directional center positioned in the center of the observation field). The quantitative analysis was performed by the wavelength-dispersive X-ray spectroscopy on the specimen to determine the composition of the center of the inclusion of interest with a width of 1 μm or more.

Elements of interest for analysis include Al, Mn, Si, Mg, Ca, Ti, Zr, S, REM (La, Ce, Nd, Dy, Y), and Nb. Using existing materials, the relationship between the X-ray intensity of each element of the existing material and the content of the element was determined to previously determine a calibration curve. Then, the content of the element in the inclusion was determined based on the x-ray intensity and the calibration curve obtained from the inclusion.

The average content (inclusion composition) of each element in the inclusion having a width of 1 μm or more and contained in the three sections was determined.

(Determination of CaS Content and RES Content)

The element S detected by the above EPMA exists as a sulfide. The rate of distribution of S to Mn, Mg, Ca, and REM which formed sulfides in the steel was derived from the following hypothesis to determine the CaS content and the RES content.

In the steel containing 0.010% or more of Al of interest in the invention, the element Mn cannot exist in the form of oxide, so that all elements of Mn in the inclusions are considered to exist in the form of MnS (calculated as Mn: S=1:1 in terms of atomic weight ratio). The remaining S content [S1], which is obtained by subtracting (S content as the MnS) from (whole S content of the inclusions), corresponds to the amount of S existing as the sulfide of Mg, Ca, and/or REM.

By comparison among the desulfurizing capacities of Mg, Ca, and REM, the following relationship is obtained: Ca>Mg>REM. The remaining elements of S exist in the form of CaS, MgS, and RES in that order as the sulfide. Thus, the Ca content and the [S1] content are used to set the CaS content (calculated as Ca: S=1:1 in terms of atomic weight ratio).

For example, if all elements of Ca in the inclusions exist in the form of CaS and even at that time some elements of S are left, the remaining S content is represented by [S2], and the remaining elements of S are distributed to Mg and REM. In this case, the distribution of S to MgS is considered (calculated as Mg: S=1:1 in terms of atomic weight ratio). The MgS content is represented by "MnS index". And, the further remaining elements of S after the calculation forms RES.

The REM contains various elements (for example, La, Ce, Nd, and the like). The amount of S distributed to each element of the REM is in proportional to the amount of addition of the corresponding element of the REM. The elements REM and S are bonded together such the atomic weight ratio of REM to S in the RES is supposed to be 1 (REM: S=1:1).

Table 5 shows the MnS content determined by the above method for understanding of FIG. 3 described above.

[Evaluation of HIC Resistance]

The HIC resistance of each specimen was evaluated by a method defined by NACE (national association of corrosion engineers) standard TM0284-2003. In detail, each specimen was immersed in an aqueous solution (0.5% NaCl+0.5% acetic acid) in which hydrogen sulfide at 1 atm is saturated, at 25° C. for 96 hours.

Figure 5:
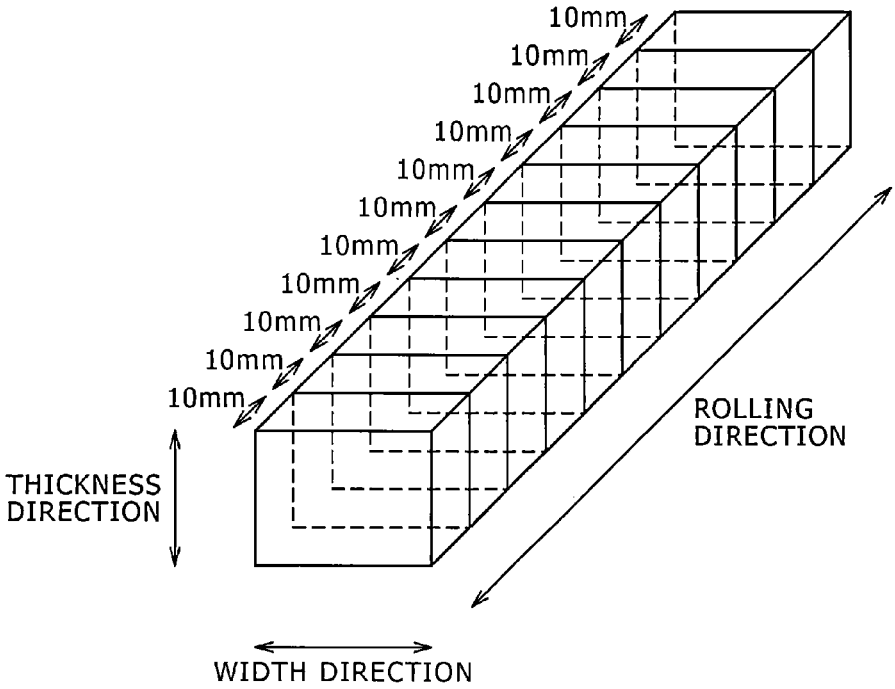
FIG. 5 is a schematic perspective view showing the shape of specimens and cut positions of the specimens used for evaluation of the HIC resistance in Examples.

The evaluation of an HIC test was performed as follows. As shown in FIG. 5, respective specimens were cut with 10 mm pitches in the longitudinal direction. After each cut surface was polished, the whole cut surface was observed at a magnification of 100× using an optical microscope. Then, the number of cracks with a cracking length of 200 μm or more generated due to the HIC, and the number of cracks with a cracking length of 1 mm or more due to the HIC were respectively counted. In the invention, the specimen without any HIC cracks having a cracking length of 1 mm or more was evaluated to have excellent HIC resistance, and the specimen with one or more HIC cracks having the length of 1 mm or more was determined to get HIC (to have the low HIC resistance). These results are shown in Tables 5 and 6 together with the thickness of the steel plate.

TABLE 5

| No. | Thickness (mm) | MnS Index | RES/CaS | Zr content of inclusion (% by mass) | Nb content of inclusion (% by mass) | Number of cracks (≥200 μm) (pieces) | Number of cracks (≥1 mm) (pieces) |
|---|---|---|---|---|---|---|---|
| 1 | 25 | 14 | 0.01 | 0 | 4 | 15 | 12 |
| 2 | 25 | 12 | 0.04 | 17 | 2 | 16 | 3 |
| 3 | 25 | 9 | 0.07 | 13 | 3 | 7 | 0 |
| 4 | 50 | 3 | 0.76 | 8 | 2 | 1 | 0 |
| 5 | 25 | 3 | 2.23 | 19 | 1 | 0 | 0 |
| 6 | 25 | 5 | 3.29 | 9 | 2 | 0 | 0 |
| 7 | 25 | 12 | 0.00 | 21 | 4 | 17 | 5 |
| 8 | 13 | 5 | 0.43 | 13 | 3 | 7 | 0 |
| 9 | 25 | 4 | 0.72 | 7 | 1 | 2 | 0 |
| 10 | 25 | 3 | 1.33 | 14 | 1 | 0 | 0 |
| 11 | 25 | 2 | 2.13 | 22 | 1 | 0 | 0 |
| 12 | 25 | 4 | 0.38 | 19 | 1 | 4 | 0 |
| 13 | 25 | 4 | 0.41 | 30 | 3 | 3 | 0 |
| 14 | 25 | 4 | 0.40 | 43 | 3 | 2 | 0 |
| 15 | 12 | 2 | 0.53 | 17 | 1 | 3 | 0 |
| 16 | 25 | 2 | 0.26 | 58 | 13 | 17 | 2 |
| 17 | 25 | 5 | 1.17 | 13 | 2 | 2 | 0 |
| 18 | 25 | 4 | 0.26 | 26 | 2 | 5 | 0 |
| 19 | 32 | 3 | 0.19 | 32 | 4 | 3 | 0 |
| 20 | 9 | 3 | 0.76 | 10 | 1 | 1 | 0 |
| 21 | 25 | 4 | 0.46 | 69 | 16 | 21 | 3 |
| 22 | 25 | 2 | 1.47 | 32 | 2 | 0 | 0 |

TABLE 6

| No. | Thickness (mm) | RES/CaS | Zr content of inclusion (% by mass) | Nb content of inclusion (% by mass) | Number of cracks (≥200 μm) (pieces) | Number of cracks (≥1 mm) (pieces) |
|---|---|---|---|---|---|---|
| 23 | 25 | 0.71 | 17 | 1 | 13 | 4 |
| 24 | 25 | 0.82 | 26 | 2 | 12 | 3 |
| 25 | 25 | 0.65 | 21 | 2 | 22 | 10 |
| 26 | 25 | 0.77 | 23 | 2 | 19 | 3 |
| 27 | 25 | 1.38 | 14 | 1 | 14 | 7 |
| 28 | 25 | 0.04 | 8 | 1 | 13 | 4 |
| 29 | 25 | 0.02 | 7 | 1 | 13 | 9 |
| 30 | 25 | 0.41 | 24 | 21 | 19 | 7 |
| 31 | 25 | 0.35 | 4 | 3 | 19 | 1 |
| 32 | 25 | 5.21 | 41 | 1 | 19 | 9 |
| 33 | 25 | 1.06 | 26 | 1 | 0 | 0 |
| 34 | 25 | 0.68 | 24 | 1 | 2 | 0 |
| 35 | 25 | 0.64 | 18 | 2 | 3 | 0 |
| 36 | 25 | 1.14 | 15 | 4 | 1 | 0 |
| 37 | 25 | 0.77 | 31 | 2 | 4 | 0 |
| 38 | 25 | 0.92 | 23 | 2 | 2 | 0 |
| 39 | 25 | 0.73 | 17 | 1 | 2 | 0 |
| 40 | 25 | 0.80 | 13 | 1 | 1 | 0 |
| 41 | 25 | 0.54 | 22 | 1 | 3 | 0 |
| 42 | 25 | 0.90 | 26 | 3 | 0 | 0 |
| 43 | 25 | 0.02 | 13 | 4 | 18 | 2 |
| 44 | 25 | 0.04 | 17 | 3 | 6 | 3 |
| 45 | 25 | 0.04 | 14 | 2 | 19 | 2 |
| 46 | 25 | 0.03 | 23 | 2 | 7 | 5 |
| 47 | 25 | 0.53 | 12 | 1 | 13 | 2 |
| 48 | 25 | 0.78 | 21 | 4 | 11 | 1 |
| 49 | 25 | 0.63 | 10 | 8 | 10 | 3 |
| 50 | 25 | 0.03 | 15 | 3 | 7 | 2 |

According to Tables 2 to 6, the following consideration can be made. That is, specimens No. 3, 4, 8 to 10, 12 to 15, 17 to 20, 22, and 33 to 42 satisfied the component composition and manufacturing conditions defined by the present invention while forming the inclusions defined by the invention, and thus are determined to have the excellent HIC resistance.

In contrast, examples except for the specimens represented by the above numbers do not satisfy at least one of the component composition, the manufacturing condition, and the inclusion composition defined by the invention, which resulted in degraded HIC resistance.

Specifically, in the specimen No. 1, REM and Zr were not added, the ratio RES/CaS was too small, and Zr was not able to be ensured in the inclusions, so that HIC was caused.

In the specimen No. 2, REM was lacking, and the ratio RES/CaS was too small, so that the HIC was caused.

In the specimen No. 7, REM was not added, and the ratio RES/CaS did not satisfy the defined range, so that the HIC was caused.

In the specimens No. 16 and 21, the Zr content of the steel was so high and exceeds the upper limit, whereby the Nb content of the inclusion was increased (specifically, in the specimen No. 21, the Zr content of the inclusion becomes excessive). As a result, the HIC was caused.

In the specimen No. 23, the C content was so high and exceeds the upper limit, whereby NbC or island-like martensite were generated to cause the HIC.

In the specimen No. 24, the Mn content was excessive, so that the MnS was formed in a large amount to thereby cause the HIC. In the specimen No. 25, the S content was excessive. In this case, the MnS was formed in a large amount, so that the HIC was caused.

In the specimen No. 26, the P content was excessive, so that the HIC was caused.

In the specimen No. 27, the Si content was excessive to generate island-like martensite, so that the HIC was caused.

In the specimen No. 28, the Al content was lacking, so that the RES was not able to be ensured sufficiently. The RES/CaS was outside the lower limit to cause the HIC.

In the specimen No. 29, the O content was excessive, so that the RES was not able to be ensured sufficiently. The RES/CaS was outside the lower limit to cause the HIC.

In the specimen No. 30, the Nb content was excessive, so that the Nb content of the inclusions exceeds the upper limit. As a result, the HIC was caused.

In the specimen No. 31, the Al content was excessive. In the smelting process, an Al oxide was preferentially formed rather than a Zr oxide, which reduced the Zr content of the inclusion to thereby cause the HIC.

In the specimen No. 32, the Ca content was lacking, so that the MnS was formed to cause the HIC.

In the specimen No. 43, in the smelting process, the element Ca was added before addition of REM and Zr, so that the RES/CaS was not able to be set to a certain value or more, which caused the HIC.

In the specimen No. 44, in the smelting process, Of/S was so high that the RES was not able to be ensured sufficiently. As a result, the RES/CaS was not able to be set to a certain value or more to thereby cause the HIC.

In the specimen No. 45, in the smelting process, the time period from the addition of Ca to the solidification was so long that the RES/CaS of a certain value or more was not obtained to thereby cause the HIC.

In the specimen No. 46, in the smelting process, the time period from the addition of REM and Zr to the addition of Ca was so short that the RES was not able to be sufficiently ensured. As a result, the RES/CaS was not able to be set to a certain value or more, so that the HIC was caused.

In the specimens No. 47 and 48, in the smelting process, desulfurizing was not performed sufficiently, and the S content was not 0.004% or less. In this way, the desulfurizing was not sufficiently performed. As a result, the MnS was formed in a large amount, so that the HIC was caused.

In order to set the S content to 0.004% or less, the result of the specimen No. 47 shows that the stirring time in the desulfurizing step should be made longer. Further, the result of the specimen No. 48 shows that the flow rate of gas can be further increased.

In the specimen No. 49, in the smelting process, the Fe content of the used slag was so low that the Nb content of the inclusion was increased to thus cause the HIC.

In the specimen No. 50, the RES/CaS was so small that the HIC was caused. The result of the specimen No. 50 shows that in order to obtain the RES/CaS of a certain level or more by sufficiently desulfurizing to reduce the S content to 0.004% or less, the CaO content of the slag should be increased.

In the specimens No. 5, 6, and 11, the steel plates with excellent HIC resistance were obtained, but the nozzle was closed, which reduced the productivity in the manufacturing process. As a result, in order to prevent the closing of the nozzle to increase the productivity, the upper limit of REM/CaS is preferably 2.0.

What is claimed is:

1. A steel plate comprising:

C: 0.02 to 0.20% (in percentage by mass, also for the following chemical components), Si: 0.02 to 0.50%, Mn: 0.6 to 2.0%, P: 0.030% or less, S: 0.004% or less, Al: 0.010 to 0.08%, N: 0.001 to 0.01%, Nb: 0.002 to 0.06%, Ca: 0.0003 to 0.0060%, O: 0.0040% or less, REM: 0.0002 to 0.05%, Zr: 0.0003 to 0.020%, and the remainder being iron and inevitable impurities, wherein, in a composition of an inclusion contained in the steel and having a width of 1 μm or more, a ratio (RES/CaS) of a mass of a REM sulfide (RES) to that of a Ca sulfide (CaS) is equal to or more than 0.05, wherein a Zr content of the inclusion is in a range of 5 to 60%, and wherein a Nb content of the inclusion is 5% or less.

2. The steel plate according to claim 1, further comprising one or more elements selected from the group consisting of:

Ti: 0.003 to 0.03%,

B: 0.0002 to 0.005%,

V: 0.003 to 0.1%,

Cu: 0.01 to 1.5%,

Ni: 0.01 to 3.5%,

Cr: 0.01 to 1.5%,

Mo: 0.01 to 1.5%, and

Mg: 0.0003 to 0.005%.

3. The steel plate according to claim 1 or 2, wherein the steel plate is used for a line pipe.

4. A steel pipe suitable for use in a line pipe, manufactured using the steel plate according to claim 3.

5. A method for manufacturing the steel plate according to claim 1, wherein a smelting process comprises the steps of:

desulfurizing by use of a slag having a Fe content in a range of 0.1 to 10% so as to set a S content to 0.004% or less;

deoxidizing such that a ratio (Of/S) of a dissolved-oxygen (Of) content of the molten steel to a S content of the molten steel is equal to or less than 10; and adding Zr, REM, and Ca in that order, or adding both Zr and REM at the same time and then adding Ca, the steps being performed in that order, wherein a time period from the addition of the REM to the addition of Ca is set to 4 minutes or more, and wherein a time period from the addition of Ca to completion of solidification is within 200 minutes.

* * * * *